US008235654B2

(12) United States Patent
Clemen

(10) Patent No.: US 8,235,654 B2
(45) Date of Patent: Aug. 7, 2012

(54) COMPRESSOR STATOR WITH PARTIAL SHROUD

(75) Inventor: Carsten Clemen, Mittenwaide (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 601 days.

(21) Appl. No.: 12/382,573

(22) Filed: Mar. 18, 2009

(65) Prior Publication Data

US 2009/0238682 A1 Sep. 24, 2009

(30) Foreign Application Priority Data

Mar. 18, 2008 (DE) ..... 10 2008 014 743

(51) Int. Cl.
*F01D 17/12* (2006.01)

(52) U.S. Cl. ..... 415/160; 415/173.7; 415/174.4; 415/174.5; 415/209.3

(58) Field of Classification Search ..... 415/160, 415/173.7, 174.2, 174.4, 174.5, 209.3, 209.4
See application file for complete search history.

(56) References Cited

U.S. PATENT DOCUMENTS

| | | | | | |
|---|---|---|---|---|---|
| 2,671,634 | A * | 3/1954 | Morley | 415/160 |
| 2,868,439 | A * | 1/1959 | Hampshire et al. | 415/141 |
| 4,477,089 | A * | 10/1984 | Hoffman et al. | 277/414 |
| 4,869,640 | A * | 9/1989 | Schwarz et al. | 415/115 |
| 5,157,914 | A * | 10/1992 | Schwarz et al. | 60/795 |
| 5,752,802 | A * | 5/1998 | Jones | 415/170.1 |
| 7,334,983 | B2 | 2/2008 | Alvanos et al. | |
| 2006/0029494 | A1* | 2/2006 | Bruce et al. | 415/160 |
| 2006/0140756 | A1* | 6/2006 | Schwarz et al. | 415/173.2 |
| 2010/0143105 | A1* | 6/2010 | Goto et al. | 415/173.7 |

FOREIGN PATENT DOCUMENTS

| | | | |
|---|---|---|---|
| EP | 1780380 | | 5/2007 |
| GB | 677274 | | 8/1952 |
| WO | WO 2008/056454 | * | 5/2008 |

OTHER PUBLICATIONS

German Search Report dated May 25, 2009 for counterpart German patent application.

* cited by examiner

*Primary Examiner* — Steven Loke
*Assistant Examiner* — Victoria Hall
(74) *Attorney, Agent, or Firm* — Timothy J. Klima; Shuttleworth & Ingersoll, PLC

(57) ABSTRACT

A gas-turbine axial compressor has a casing 3 and a rotatable shaft 6, which form an annular duct, in which at least one stator 2 and one rotor 4 are arranged. A shroud 21 is arranged at a free end of the stator 2 vanes, which extends over part of the axial length of the stator 2. A rotor platform 23 of at least one rotor 4 extends axially beneath a further part of the axial length of the stator 2, at which no shroud 21 is arranged.

19 Claims, 6 Drawing Sheets

Figure 9:
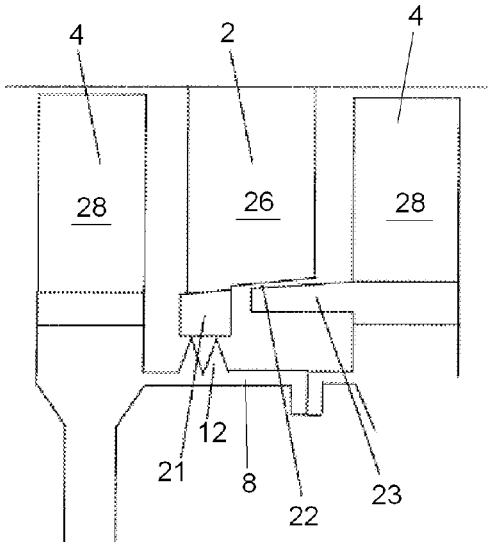

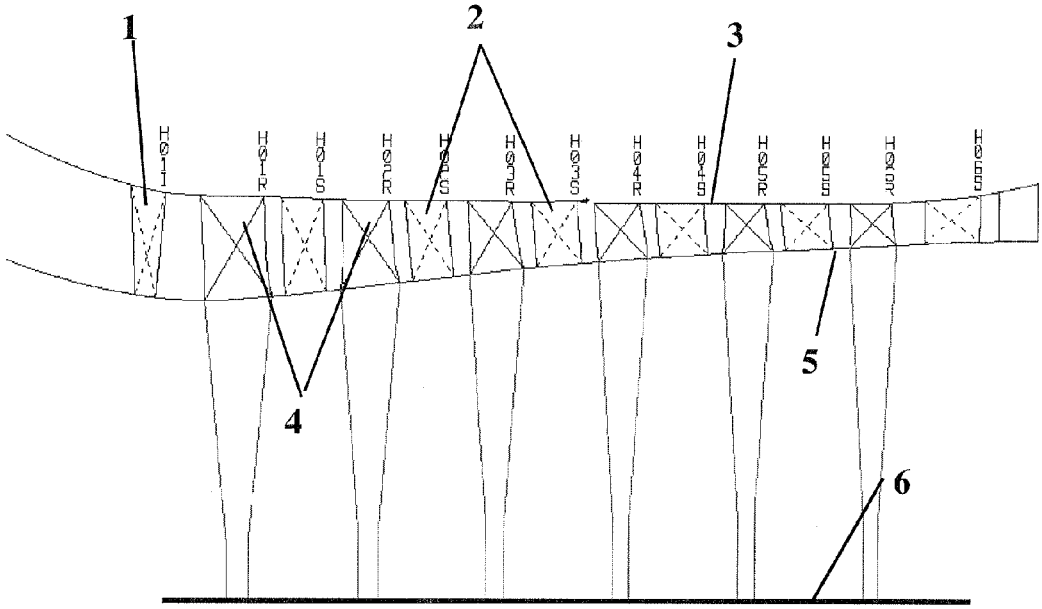
Fig. 1: Prior Art
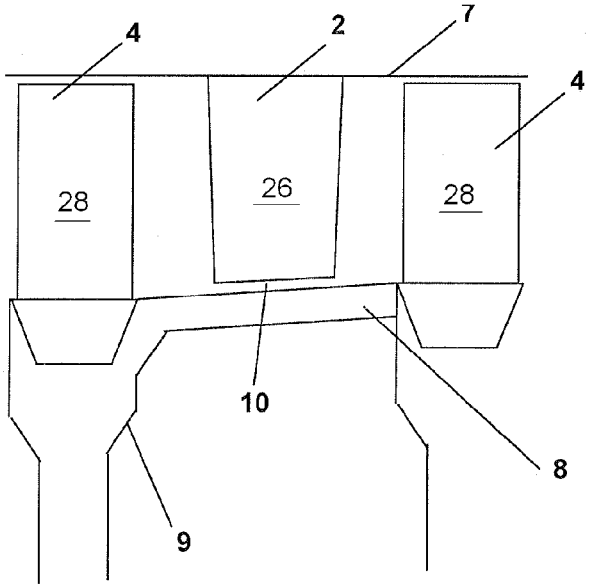
Fig. 2: Prior Art

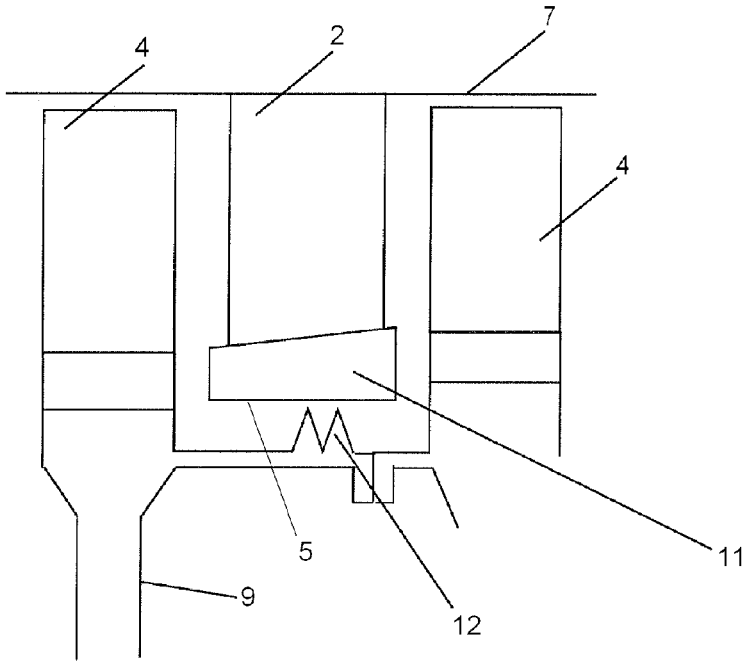
Fig. 3: Prior Art
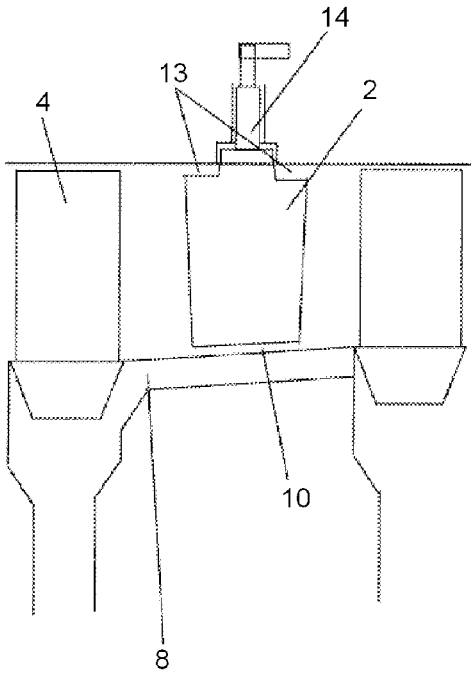
Fig. 4: Prior Art
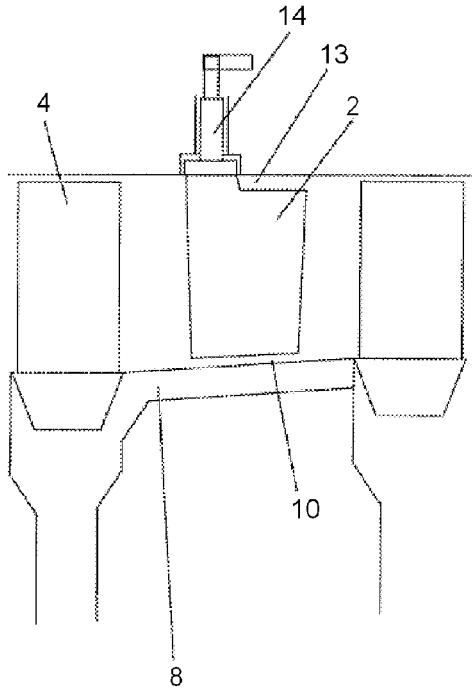
Fig. 5: Prior Art

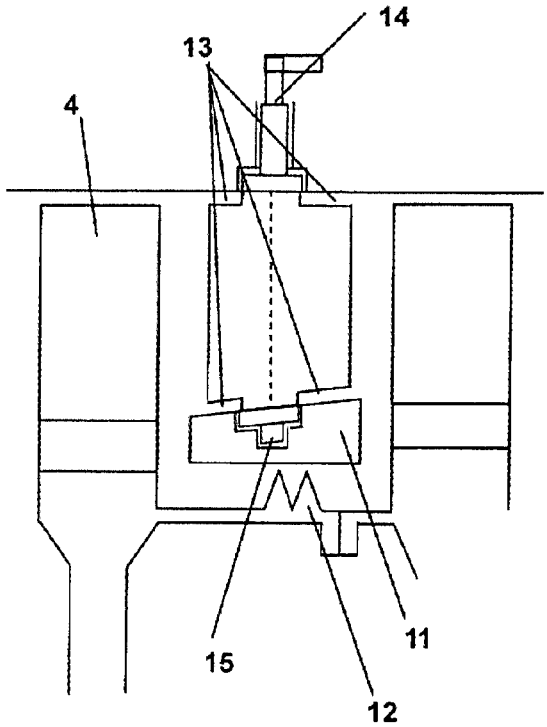
Fig. 6: Prior Art
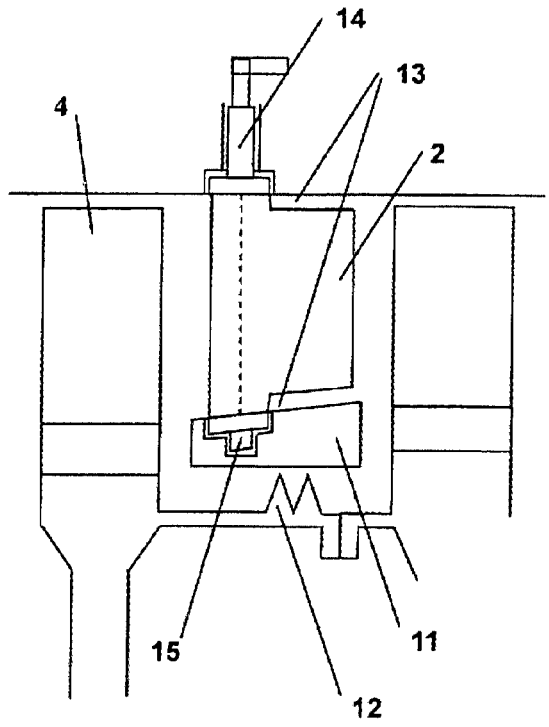
Fig. 7: Prior Art

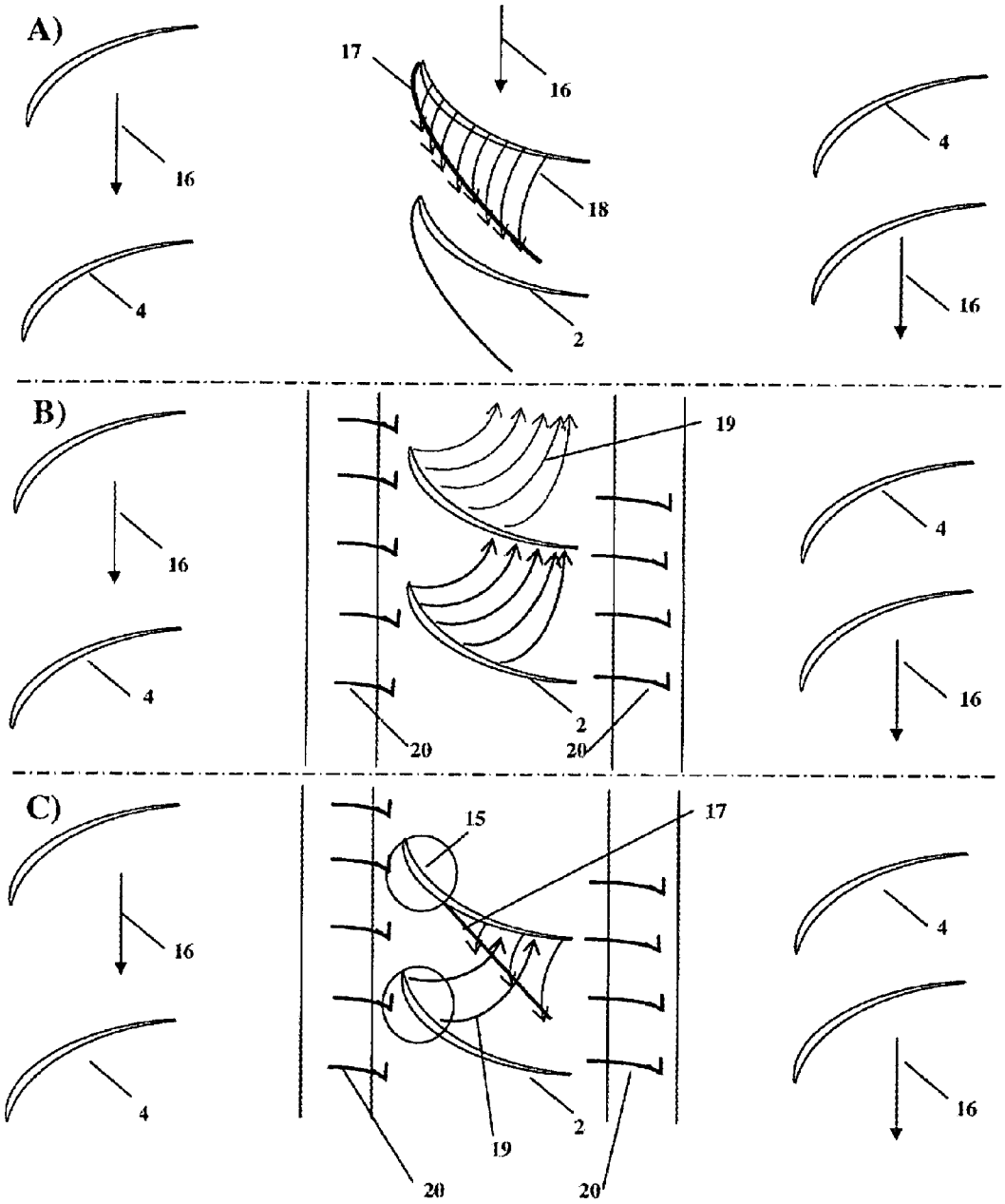
Fig. 8: Prior Art

COMPRESSOR STATOR WITH PARTIAL SHROUD

This application claims priority to German Patent Application DE102008014743.5 filed Mar. 18, 2008, the entirety of which is incorporated by reference herein.

This invention relates to a gas-turbine compressor.

More particularly, the present invention relates to an axial-flow compressor of a gas turbine with a casing and a hub which form an annular duct in which at least one stator and one rotor are arranged. As usual, the stator includes a row of stator vanes, while the rotor, as usual, includes a row of rotor blades.

Axial-flow compressors include one or several compressor stages, with each stage having a rotor 4 with rotor blades 28 and a stator 2 with stator vanes 26, additionally, the compressor may feature a so-called inlet guide vane assembly 1 upstream of the first stage (FIGS. 1-2).

The stators 2 are characterized in that they are not attached to the compressor shaft 6 and, therefore, do not rotate, while the rotors 4 are attached to the compressor shaft 6 and, therefore, do rotate. This means that rows of rotating blades 28 and stationary vanes 26 alternate in a compressor and suitable attachment of the stators 2 is to be provided. For this, the state of the art provides two arrangements:

1. Stator 2 with a hub gap 10, with the compressor shaft (not shown) further extending underneath the stator 2 (FIG. 2). In this arrangement, the stator 2 is connected to the compressor casing 7 only.
2. Stator 2 with a shroud 11, with the stator 2 being connected to the stator hub 5 via a ring, the so-called shroud 11 (FIG. 3).

This shroud 11 extends over the entire axial length of the stator 2 from the leading edge to the trailing edge and even beyond both edges. The shroud 11 freely hangs over the compressor shaft (not shown) located underneath. In this arrangement, an axial gap exists between the rotor 4 and the stator hub 5 before and behind the stator 2. This gap leads to flow leakage, which is reduced by seals 12 acting against the compressor shaft 6 (FIG. 3).

On many compressors, some of the stator vane rows are variable. Application of the two above mentioned types of attachment to such variable stators, see FIGS. 4 and 5, constitutes the state of the art. In order to provide for rotatability of the variable stators, trunnions 14 are used to suspend the stators 2 in the casing (FIGS. 4-5) or in the casing and in the hub shroud (FIG. 6), respectively. The trunnions 14 are connected to the vanes via disks. They can be arranged either at the stator leading edge, in which case a radial gap between the vane end and the casing wall or the hub shroud, respectively, exists only behind the trunnion 14 (FIG. 5), or such that a radial gap exists both before and behind the trunnion 14 (FIG. 4).

The state of the art entails the disadvantageous effects shown in FIG. 6:

Stator with hub gap (FIG. 2): The hub gap leads to a strong gap flow 18 which entails severe losses and disturbances in the compressor flow (FIG. 8*a*).

Stator with hub shroud 11 (FIG. 3): The design with hub shroud 11 is mechanically complex, heavy and expensive. A strong transverse duct flow 19 is produced on the stationary hub shroud 11 from the stator pressure side to the stator suction side. The transverse duct flow 19 tends to flow onto the vane suction side. This leads to flow separation on the vane and, thus, to high losses. The leakage flow 20 past the axial gap, which is before and behind the shroud 11, is driven by a large pressure gradient between the stator leading edge and the stator trailing edge and, as its interacts with the main flow, can consequently become large or produce severe losses (FIG. 8*b*).

On the variable stator with hub shroud 11, the phenomena of FIGS. 8*a* and 8*b* combine with each other, this leading to even higher losses (FIG. 8*c*).

A broad aspect of the present invention is to provide a gas-turbine axial compressor of the type specified at the beginning above, which, while being simply designed and cost-effectively producible, features increased efficiency and avoids the disadvantages of the state of the art.

The present invention therefore provides for a stator having a shroud at the respective free end of the stator vanes. However, this shroud does not extend over the entire axial length of the stator vanes, but only over a partial area. According to the present invention, the shroud can be provided in a center area of the stator vanes, centrally to the latter or, in the direction of flow, at the inflow area of the stator or at the outflow area, respectively.

The stator according to the present invention accordingly has a shroud provided over a partial area of its axial length, with the shroud being preferably sealed by a conventional seal (lip-type seal or similar) to avoid or reduce leakage flows.

The present invention also provides for a further axial—partial—area of the stator being located adjacent to a rotor hub or a rotor platform. Here, a radial hub gap occurs between rotor hub and stator vane. The rotor hub or rotor platform can preferably be provided in the form of an extension or projection of a rotor disk.

The axial length of the shroud and the axial length of the rotor platform or the rotor hub (axial length of the hub gap) can add to the total axial length of the stator or the stator vane, respectively. However, it is also possible to seal and provide only parts of the entire length in the manner described.

The axial—partial—area of the stator having a hub gap can be unilaterally disposed in the flow direction before or behind the area provided with the shroud. On a central shroud, the hub gap area with the rotor hub or the rotor platform can, however, also be disposed both before and behind the shroud. In this respect, a great variety of modifications and variations are allowed without departing from the inventive concept.

Figure 10:
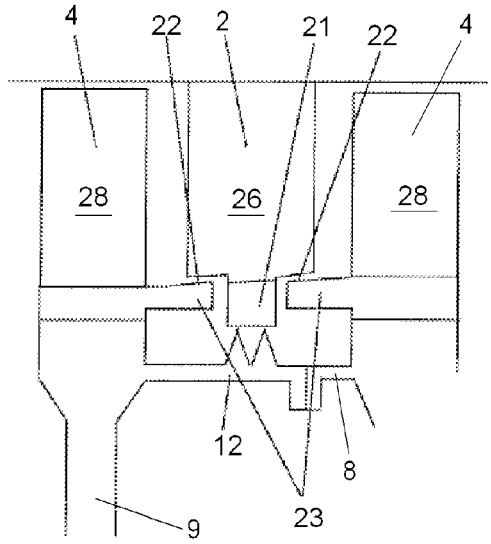
Figure 11:
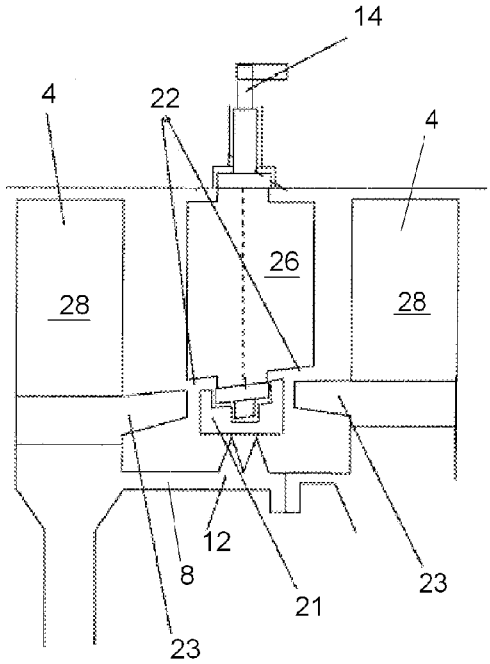
Figure 12:
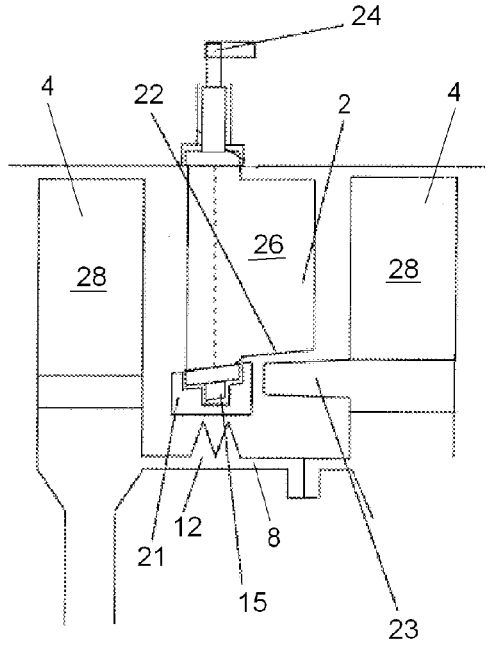

The present invention is more fully described in light of the accompanying drawings showing preferred embodiments. In the drawings, FIG. 1 (Prior Art) is a general view of a gas-turbine axial compressor known from the state of the art, FIG. 2 (Prior Art) is an enlarged (schematic) detail view in accordance with the state of the art with the stator arrangement featuring a hub gap, FIG. 3 (Prior Art) is an enlarged (schematic) detail view in accordance with the state of the art with the stator arrangement featuring a hub shroud, FIG. 4 (Prior Art) is a schematic representation of a variable stator with hub gap in accordance with the state of the art, FIG. 5 (Prior Art) is a schematic representation of a variable stator with hub gap in accordance with the state of the art, FIG. 6 (Prior Art) is a schematic representation of a variable stator with hub shroud in accordance with the state of the art, FIG. 7 (Prior Art) is a schematic representation of a variable stator with hub shroud in accordance with the state of the art, FIG. 8 (Prior Art) is a schematic representation of the flow phenomena in the state of the art, FIG. 9 is a schematic representation, analogically to FIGS. 4-7, of a first inventive embodiment of a stator with partial shroud, FIG. 10 is a schematic representation, analogically to FIG. 9, of a further embodiment of a stator with partial shroud, FIG. 11 is a schematic representation, analogically to FIGS. 9 and 10, of a further embodiment of a variable stator with partial shroud, FIG. 12 is a schematic representation, analogically to FIGS. 9 and 10, of a further embodiment of a variable stator with partial shroud, and FIG. 13 is a schematic representation, analogically to FIG. 8, of the flow phenomena with inventive embodiments.

FIGS. 9-12 show examples according to the present invention of a stator 2, or a variable stator 2, with partial shroud 21. The present invention accordingly provides for the rotor platform 23 of the downstream and/or upstream rotor 4 being extended underneath the stator 2 so that a rotating hub body is provided beneath the stator 2. The rotating hub body (rotor platform 23) extending beneath the stator vanes 26 is, unlike the stator 2 with full hub gap 10, not continuous to the next rotor 4, but covers only part of the stator 2. At the same time, the stator 2 is still provided with a partial shroud 21. The partial hub gap 22 is either before and behind or only behind the partial shroud 21 hanging between the two rotating rotor hub bodies (rotor platform 23). The axial gap between the rotating hub body and the partial shroud 21 is beneath the stator vanes 26.

On variable stators (FIGS. 11-12), the base, i.e. the location of the trunnion axis, is accommodated in the partial shroud 21. This also applies to a full shroud (not shown).

Figure 13:
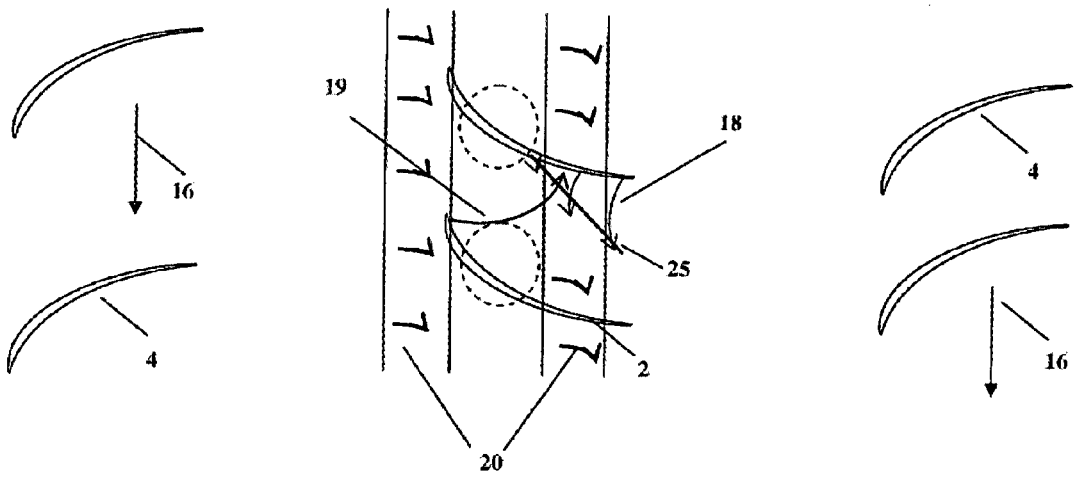

Physically, the arrangement according to the present invention has the effect described hereunder with reference to FIG. 13.

The transverse duct flow 19 is weaker than with a full shroud, the gap flow 18 is weaker than with a full gap, the transverse duct flow 19 is prevented by the partial gap 22 from reaching the suction side and causing separation and losses on the latter.

Since the axial gap does not lie before and behind the stator 2, but closer together, the static pressure difference responsible for the leakage flow 20 is significantly smaller. The leakage flow 20 is approx. 40 percent less than with a full shroud, i.e. the losses and the heating of the flow produced by it are approximately 40 percent less.

The arrangement with partial shroud according to the present invention is significantly lighter than the arrangement with full shroud. This leads to savings in both weight and cost. Furthermore, the aerodynamic properties of the partial shroud are superior to those of the state of the art, as described by way of comparison in the FIGS. 6 and 13. This means lower losses in the flow and, thus, increased compressor efficiency.

LIST OF REFERENCE NUMERALS

1 Inlet guide vane assembly
2 Stator
3 Casing
4 Rotor
5 Stator hub
6 Compressor shaft
7 Compressor casing
8 Rotor hub
9 Rotor disk
10 Hub gap
11 Shroud
12 Sealing lip
13 Partial gap
14 Trunnion
15 Trunnion base
16 Sense of rotation
17 Gap swirl
18 Gap flow
19 Transverse duct flow
20 Leakage flow
21 Partial shroud
22 Partial gap
23 Rotor platform
24 Variable vane arm
25 Gap swirl path
26 Stator vanes
28 Rotor blades

What is claimed is:

1. A gas turbine axial compressor comprising:

a casing and a rotatable shaft, which form an annular duct;

at least one stator having a plurality of stator vanes and a first rotor having a plurality of rotor blades positioned in the annular duct, the first rotor having a first rotor platform positioned at bases of the rotor blades;

a shroud positioned at free ends of the stator vanes and which extends over only an incomplete portion of an axial span of the stator vanes to form an unshrouded vane portion including at least one of: leading portions of the stator vanes extending axially forward of an axially forward-most edge of the shroud, or trailing portions of the stator vanes extending axially rearward of an axially rearward-most edge of the shroud;

wherein the first rotor platform is radially aligned with at least a portion of the shroud and extends axially below the unshrouded vane portion.

2. The gas turbine axial compressor of claim 1, wherein the first rotor platform is unilaterally positioned on one side of the shroud of the stator.

3. The gas turbine axial compressor of claim 2, and further comprising a second rotor positioned in the annular duct and having a second rotor platform;

wherein the second rotor platform is radially aligned with at least a portion of the shroud and extends axially below the unshrouded vane portion on an opposite side of the shroud of the stator than the first rotor platform.

4. The gas turbine axial compressor of claim 1, and further comprising a seal engaging the shroud to seal the shroud.

5. The gas turbine axial compressor of claim 1, wherein the stator is a variable stator.

6. The gas turbine axial compressor of claim 5, wherein the variable stator comprises a trunnion base that accommodates the shroud.

7. The gas turbine axial compressor of claim 1, wherein the first rotor includes a first rotor disk, and the first rotor platform is attached to the first rotor disk.

8. The gas turbine axial compressor of claim 7, and further comprising a seal positioned between the shroud and the first rotor to seal between the shroud and the first rotor.

9. The gas turbine axial compressor of claim 2, and further comprising a seal engaging the shroud to seal the shroud.

10. The gas turbine axial compressor of claim 2, wherein the stator is a variable stator.

11. The gas turbine axial compressor of claim 10, wherein the variable stator comprises a trunnion base that accommodates the shroud.

12. The gas turbine axial compressor of claim 11, wherein the first rotor includes a first rotor disk, and the first rotor platform is attached to the first rotor disk.

13. The gas turbine axial compressor of claim 12, and further comprising a seal positioned between the shroud and the first rotor to seal between the shroud and the first rotor.

14. The gas turbine axial compressor of claim 3, and further comprising a seal engaging the shroud to seal the shroud.

15. The gas turbine axial compressor of claim 3, wherein the stator is a variable stator.

16. The gas turbine axial compressor of claim 15, wherein the variable stator comprises a trunnion base that accommodates the shroud.

17. The gas turbine axial compressor of claim 3, wherein the first rotor includes a first rotor disk, and the first rotor platform is attached to the first rotor disk.

18. The gas turbine axial compressor of claim 17, and further comprising a seal positioned between the shroud and the first rotor to seal between the shroud and the first rotor.

19. The gas turbine axial compressor of claim 3, and further comprising:

a rotor hub connecting the first rotor and the second rotor; and a seal positioned between the shroud and the rotor hub to seal between the shroud and the rotor hub.

* * * * *